United States Patent [19]

Köbler

[11] 4,290,363

[45] Sep. 22, 1981

[54] INKING SYSTEM FOR A PRINTING MACHINE

[75] Inventor: Ingo Köbler, Gessertshausen, Fed. Rep. of Germany

[73] Assignee: M.A.N.-Roland Druckmaschinen Aktiengesellschaft, Augsburg, Fed. Rep. of Germany

[21] Appl. No.: 145,270

[22] Filed: Apr. 30, 1980

[30] Foreign Application Priority Data

May 18, 1979 [DE] Fed. Rep. of Germany ..... 2920152

[51] Int. Cl.[3] ..... B41F 31/06; B41F 31/12; B41F 31/34; B41L 27/08

[52] U.S. Cl. ..... 101/351; 101/363; 101/DIG. 14

[58] Field of Search ..... 101/350, 351, 352, 363, 101/364, 348, 349, 148, 206–210, 147, 356, 357, 360, 361, DIG. 14; 118/258, 259, 261, 262

[56] References Cited

U.S. PATENT DOCUMENTS

| | | | |
|---|---|---|---|
| 1,262,709 | 4/1918 | Smith | 101/363 |
| 2,971,460 | 2/1961 | Shindle | 101/348 X |
| 3,433,155 | 3/1969 | Norton | 101/148 |
| 3,467,008 | 9/1969 | Domotor | 101/350 |
| 3,986,452 | 10/1976 | Dahlgren | 101/148 |
| 4,130,057 | 12/1978 | List | 101/352 X |

FOREIGN PATENT DOCUMENTS

| | | | |
|---|---|---|---|
| 547992 | 3/1932 | Fed. Rep. of Germany | 101/364 |
| 2052806 | 5/1972 | Fed. Rep. of Germany | 101/350 |
| 1401718 | 12/1965 | France | 101/350 |
| 580499 | 10/1976 | Sweden | 101/350 |

*Primary Examiner*—J. Reed Fisher

*Attorney, Agent, or Firm*—Frishauf, Holtz, Goodman & Woodward

[57] ABSTRACT

Ink is supplied to a plate cylinder (9) from an ink transfer cylinder. Two ink metering rollers (10, 13) are associated with the transfer cylinder, and in surface engagement therewith. The nip or engagement gap of the rollers (10, 13) with respect to the transfer cylinder (7) is adjustable. One of the two rollers (10) is supported with an additional positioning arrangement (8, 19, 20) to adjust the gap or nip of that one roller with respect to the other measuring or metering roller (13). The respective measuring or metering rollers are independently driven, such that the surface speed of the first metering roller, which has ink applied thereto, is counter the direction of rotation of the transfer cylinder (7), and the other metering roller is driven at a surface speed which is higher than that of the transfer cylinder but in the same direction of rotation. Ink is applied to the first metering roller (10) by an ink application roller (3) which has ink applied thereto, for example from an ink trough. Preferably, at least one of the rollers or cylinders is cooled and axially oscillating. The resulting film of ink on the transfer cylinder, for application to the plate cylinder (9), will be thin and uniform.

11 Claims, 3 Drawing Figures

Fig.2
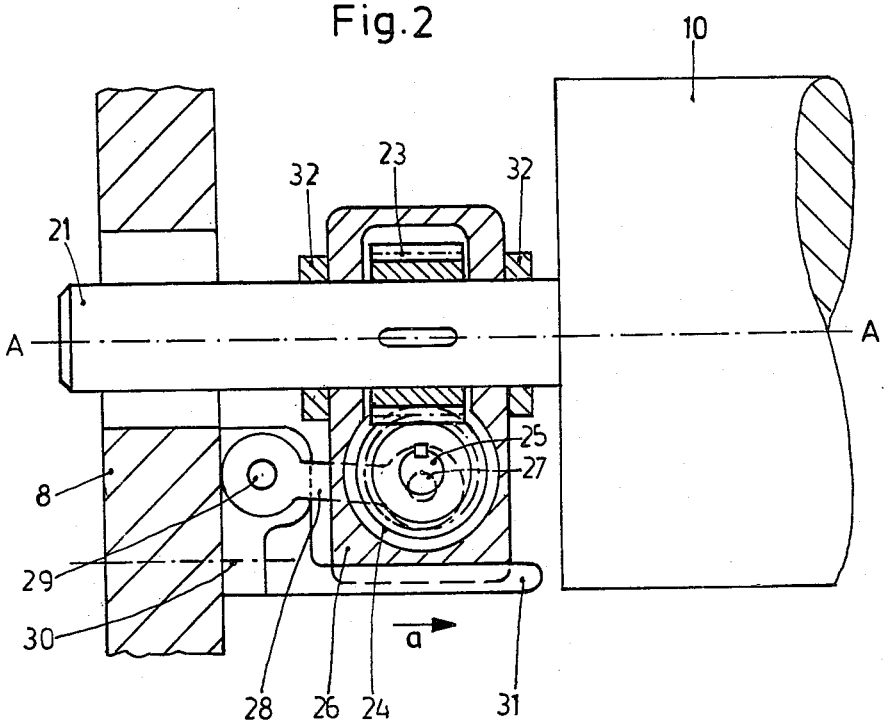
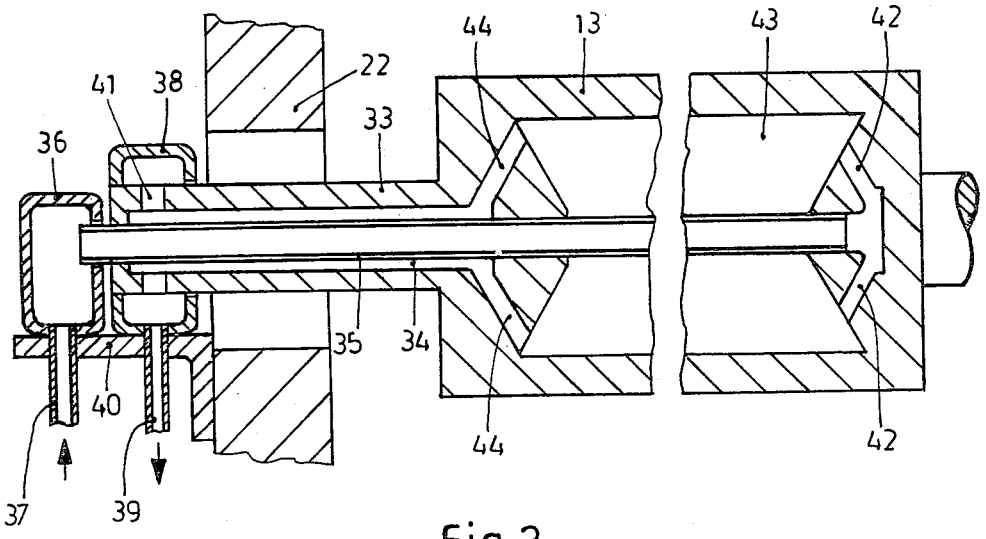
Fig.3

INKING SYSTEM FOR A PRINTING MACHINE

The present invention relates to printing machines, and more particularly to an inking system for a printing machine in which ink is supplied to an ink transfer cylinder which rotates at approximately the same speed as a plate cylinder, and by which ink is transferred to the plate cylinder. Ink is applied to the transfer cylinder by ink measuring and application rollers which receive ink from an ink supply for subsequent application to the transfer cylinder.

BACKGROUND AND PRIOR ART

Inking systems to which the present invention relates are known in the literature see, for example, the referenced German Disclosure Document No. DE-OS 2 052 806. As disclosed in this publication, measuring or metering rollers are provided which rotate with approximately the same surface speed as the ink transfer cylinder and the plate cylinder. Operating experience has shown that the uniformity and thickness or, rather, thinness of the film of ink applied by the system to the transfer cylinder can still be improved.

THE INVENTION

It is an object to provide an inking system for a printing machine, for example an offset printing machine, which is simple, requires but little space, and is capable of applying a film of ink on an ink transfer cylinder which is uniform and of accurate, predetermined thickness.

Briefly, two of ink metering rollers are provided, in surface engagement with the ink transfer cylinder. The metering rollers are journaled in bearings which are adjustable, so that the engagement gap or nip between the metering rollers and the transfer cylinder can be adjusted. The ink measuring rollers are positioned adjacent each other for surface ink transfer contact with the ink transfer cylinder. The arrangement is so located that one of the metering rollers is in engagement with the other as well, the engagement nip or gap between the two metering rollers being adjustable, for example by journaling one of the two metering rollers in ink elements which are pivotable about the axis of rotation of the ink transfer cylinder. The ink measuring rollers are individually driven by variable controllable speed drives. An ink application roller is in engagement with, in the direction of rotation of the transfer cylinder—the first one of the metering rollers to apply ink thereto. The first one of the metering rollers is driven in a direction counter the direction of rotation of the transfer cylinder to remove ink accumulating on the surface of the measuring roller, whereas the other measuring roller is driven in the same direction of rotation as the transfer cylinder, and at a higher surface speed.

DRAWINGS

FIG. 2 is a sectional side view of the transfer cylinder and illustrating an oscillating arrangement therefor; and FIG. 3 is a fragmentary sectional view through one of the metering or measuring rollers and illustrating a cooling arrangement therefor.

Figure 1:
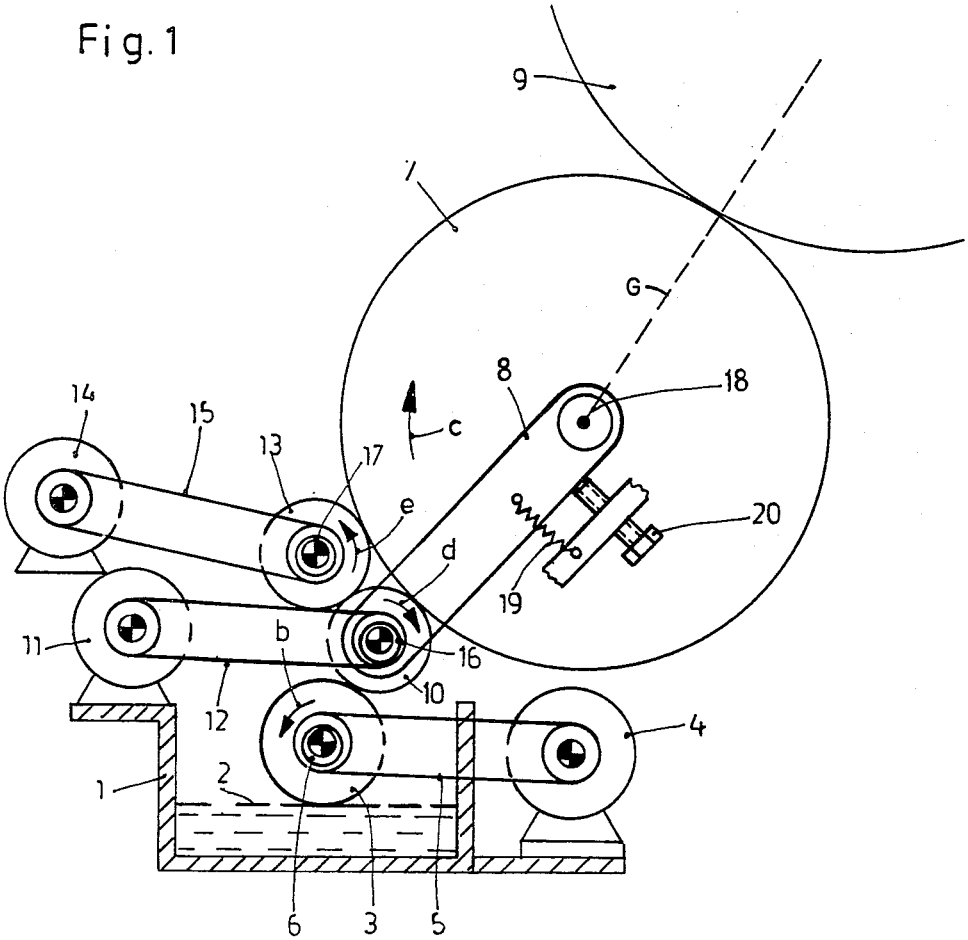
FIG. 1 is a highly schematic side view of the system illustrating the roller and cylinder arrangement.

The inking system has an ink trough 1 within which printing ink is retained, in suitable and well known manner—not further shown—such that the surface 2 of the ink in trough 1 is at an essentially uniform level. An ink application roller 3 dips partially below the surface 2. The application roller 3 is driven by a belt drive 5 from a motor 4. The drive is a variable speed drive, for example a variable speed belt drive, a variable speed motor, or the like. Other arrangements to drive the roller 3 may be used. The two axial ends of the roller 3 are held in bearings 6 which are of the eccentric type. The eccentric bearings 6 form an adjustment arrangement in order to adjust the nip or gap between the ink application roller 3 and an ink measuring or metering roller 10. The metering roller 10 is in surface contact with an ink transfer cylinder 7 and a second metering roller 13.

Each one of the rollers 10, 13 is driven, individually, by a belt drive 12, 15, respectively, from a respective motor 11, 14. Any other suitable drive connection may be used, so long as the arrangement permits variation and control of the surface speed of the rollers 10, 13, respectively, independently of each other. It is also possible to drive the roller 10 from motor 4, for example by using an additional drive, with a gearing ratio appropriate for the surface speed of roller 10.

The respective axial ends of the roller 10 are journaled in eccentric bearings 16. The bearings 16 are positioned at one end of an elongated positioning lever 8 which is pivoted about a shaft 18, concentric with the axis of rotation of the ink transfer cylinder 7. The lever 8 is engaged by a spring 19 which tends to lift the roller 10 away from the adjacent metering or measuring roller 13. An adjustment screw 20 is provided in order to adjust and control the gap between the rollers 10, 13 counter the bias force of the spring 19. The two eccentric bearings 16 provide an adjustment arrangement to adjust the nip or gap between the roller 10 and the ink transfer cylinder 7.

The second roller 13 likewise is journaled at its axial ends by eccentric bearings. The eccentric bearings 17 for roller 13 form a positioning and adjustment arrangement permitting adjustment of the gap between the roller 13 and the ink transfer cylinder 7.

The ink transfer cylinder 7 is in direct engagement with a plate cylinder 9. Rather than providing for direct engagement, intermediate idler rollers between the transfer cylinder 7 and the plate cylinder 9 may be used, for example carried along by frictional engagement with the respective cylinder. The transfer cylinder 7 is driven, as schematically shown by broken line G, for example as well known, and not further shown in detail, by a gear drive rotating with the plate cylinder 9, so that the surface speed of the ink transfer cylinder 7 and of the plate cylinder 9 is the same or generally essentially the same.

The diameters of the two rollers 10, 13 are smaller than half the diameter of the ink transfer cylinder 7.

Preferably, rollers 10, 13 as well as cylinder 7 are axially shifting or axially oscillating rollers and cylinders, respectively.

Operation: The ink application roller 3 is driven in the direction of the arrow b at a slow speed. Ink is transported from the trough 1 to the first roller 10. Ink applied to the first roller 10 is premetered in the gap or nip between the two metering rollers 10, 13. Metering of the ink is obtained by adjustment of the gap or nip width by means of screw 20, and controlling the surface speed of the roller 10. The surface speed of the roller 10 should be just slightly above stopped, i.e. null, or zero, or may even be stopped or zero, and a value which, in its absolute magnitude, corresponds to the surface speed of the ink transfer cylinder 7. Excess ink is run down or directly dripped off into the ink trough 1. A film of ink is formed in the gap or nip between the rollers 10, 13. A portion of the ink passes through the gap or nip and will pass between the ink transfer cylinder 7 and the roller 10. The direction of rotation of the ink transfer cylinder is indicated by arrow c which, as can be seen, is counter the direction of rotation of roller 10, as illustrated by arrow d. Since the metering roller 10 is axially oscillating, the layer of ink being applied to the transfer cylinder 7 will be made uniform. A portion of the ink may flow back into the trough 1.

The film of ink which was applied by the roller 10, and already was premetered, will then reach the engagement nip or gap between the cylinder 7 and the second metering or measuring roller 13. The second metering roller 13 is driven at a surface speed which is higher than the surface speed of the transfer cylinder 7. Due to the higher surface speed, the second metering roller 13 will remove ink from the entire quantity of ink on the film being applied thereto. Removal of more than half the ink applied thereto is suitable. The roller 13 rotates in the direction of the arrow e which is also the direction of removal of ink. The so removed ink will flow back or drip off, in part, directly into the trough 1; the remainder will find its way to the nip between rollers 10, 13 for re-application or blockage thereat, and subsequent run-down into trough 1. It is also possible to associate a doctor blade or scraper with the roller 13 in order to strip ink from its surface and guide it directly back into the trough 1.

Increasing the difference in surface speed between the transfer cylinder 7 and the roller 13 will cause the film of ink on the transfer cylinder 7 to become thinner.

Ink in the gap or nip between the respective rollers and cylinders becomes heated. To rapidly remove this heat, the rollers 10 and 13, but at least roller 13, preferably, are cooled.

The thickness of the film of ink which the transfer cylinder 7 applies to the plate cylinder 9 can be controlled by adjusting the gap or nip between the rollers 10, 13 as well as, individually, between the respective rollers 10, 13 and the ink transfer cylinder 7, in combination with changing the respective surface speeds of the rollers 10, 13 with respect to each other and to the ink transfer cylinder 7.

The ink transfer cylinder 7 which applies ink to the plate cylinder 9 can also be driven in an axially oscillating mode if intermediate idler rollers (not shown, and well known in the art) are interposed between the cylinder 7 and the cylinder 9. It is also possible to additionally cool the cylinder 7 or to only cool cylinder 7 instead of cooling rollers 10, 13, as schematically indicated by arrow C in FIG. 1.

Axial oscillating drive—with reference to FIG. 2:

The metering roller 10 is retained by means of a stub shaft 21 in the link 8 (see also FIG. 1), for example by a bearing (not shown), as well known. The stub 21, journaled in the link 8, has a gear 23 secured thereto which is engagement with a worm 24, the shaft 25 of which is journaled in a housing 26. The housing 26 surrounds the worm 24 and gear 23. The housing 26 is secured to the stub shaft 21 to be pivotable with respect thereto, but axially fixed thereon. The worm 24 has a pin 27 to which one end of a lever 28 is attached, the other end of which is pivotally secured to a pin or bolt 29. Pin or bolt 29 is securely attached to a bracket 30 which, in turn, is attached to the side wall 22 of the machine. The bracket 30 is formed with two guide rails 31 between which the lower end of the housing 26 is guided.

Operation: Let it be assumed that the ink metering roller or cylinder 10 rotates about the axis A-A. Gear 23, secured to the stub shaft 21, will likewise rotate. This rotates the worm 24, since housing 26, in which the worm is journaled, cannot follow the rotation due to its retention within the guide rails 31. Upon rotation of the worm 24, pin 27 will follow along, so that the lower end of the lever 28 which is pivoted on the pin 29 will move the housing 26 in the direction of the arrow a, or counter the direction thereof. Housing 26 is secured against shift on the stub shaft 21 by rings 32 secured on the stub shaft, and thus movement thereof in the direction of the arrow a or counter the direction of arrow a will carry the stub shaft 21, and hence the roller 10 along, thus causing roller 10 to oscillate in axial direction. Thus, the roller 10 will carry out its axially oscillating movement distributing the film of ink uniformly thereon.

Other arrangements to axially oscillate a roller may be used.

Cooling of metering or measuring rollers and/or of transfer cylinder, with reference to FIG. 3:

The drawing shows, to a different and enlarged scale, cooling of one of the metering or measuring rollers, specifically of measuring roller 13. A similar arrangement can be used with respect to the other rollers or cylinders of the inking system. A stub shaft 32, with which the metering roller 13 is journaled in the side wall 22 of the machine is formed with an internal axial bore 34. A pipe or tube 35 of slightly smaller diameter, and extending throughout the length of the roller 13, is passed through the bore 34. Pipe 35 terminates with its end in a cooling water supply head 37. Similarly, a cooling water removal head is applied over the terminal end of stub shaft 33 to remove cooling water from the space between the pipe or tube 35 and the inner wall of the bore 34. Cooling water is removed from head 38 through an outlet line 39. The lines 37, 39 and the heads 36, 38, respectively, are secured to a carrier bracket 40 rigidly attached to side wall 22. The shaft 33 is journaled in the side wall 22 by a bearing of any suitable kind, the showing of which has been omitted from the drawing for simplicity and to better illustrate the cooling arrangement. The heads 36, 38 are sealed, for example by O-rings or the like, and not shown, in any well known manner with respect to the stub shaft 33 and the pipe 35 which rotates with the respective roller or cylinder.

Operation of cooling system:

Cooling water is supplied through line 37 into the head 36, flowing through the pipe 35 and then through distribution bores 42 formed in the interior of the respective roller 13. The inner end of pipe 35 is secured within the roller 13, as seen in FIG. 3. Cooling water can then escape through further bores 44 at the other end of the roller 13 in the annular space between pipe 35 and the inner wall of bore 34, and then flow to the end portion where it can pass through diametrical bores 41 within the interior of the removal head 38 and then into the outlet line 39.

While a preferred form of cooling arrangement has been shown, other cooling arrangements for the respective rollers may be used. A similar arrangement may be used for the measuring roller 13 and, if needed, also for the transfer roller or cylinder 7, as schematically indicated by arrow c in FIG. 1.

Various changes and modifications may be made and features described in connection with any one of the embodiments may be used with any of the others, within the scope of the inventive concept.

I claim:

1. In a printing machine having a plate cylinder (9), an inking system having an ink transfer cylinder (7) transferring ink to the plate cylinder and rotating with approximately the same surface speed as the plate cylinder (9);

an ink application roller (3) positioned to have ink applied thereto from an ink supply (1, 2);

two ink measuring rollers (10, 13) in surface contact with the transfer cylinder (7);

and comprising, in accordance with the invention, adjustable bearing means (16, 17) journaling and supporting the respective measuring or metering rollers (10, 13) at a controllable distance with respect to the circumference of the ink transfer cylinder (7) to permit adjustment of the engagement gap or nip between the respective metering roller and the the surface of the ink transfer cylinder, said ink measuring or metering rollers being positioned adjacent each other in surface ink transfer contact;

a bearing adjustment means (8, 19, 20) journaling one (10) of said rollers to controllably adjust the engagement nip between said two adjacent rollers;

said ink application roller (3) being further positioned in ink transferring surface engagement with one (10) of said measuring rollers;

means (6) controllably adjusting the engagement nip between the ink application roller (3) and the associated ink measuring or metering roller (10);

an individual drive system (11, 12; 14, 15) associated and in driving connection with the respective ink measuring or metering rollers.

the drive system (11, 12) which drives the measuring or metering roller (10) in engagement with the ink application roller (3) driving said engaged measuring or metering roller (10) in a direction counter the direction of rotation of the ink transfer cylinder (7) and at a controllable adjustable surface speed;

the drive system (14, 15) which drives the contacting measuring roller (13) driving said contacting measuring roller (13) in the same direction of rotation as the ink transfer cylinder (7) and a surface speed higher than that of the ink transfer cylinder; and the measuring roller (13) being driven at said higher speed being positioned—with respect to the direction of rotation of the ink transfer cylinder (7)—behind the roller being driven in the opposite direction of rotation.

2. System according to claim 1, wherein the maximum surface speed of the measuring roller (10) in engagement with the ink application roller is at the most equal to the magnitude of the surface speed of the ink transfer cylinder (7).

3. System according to claim 1, further including a drive connection (G) between the ink transfer cylinder (7) and the plate cylinder (9).

4. System according to claim 1, wherein the diameter of each of the ink metering or measuring rollers (10, 13) is less than half the diameter of the ink transfer cylinder (7).

5. System according to claim 1, wherein at least one of the ink measuring or metering rollers (10, 13) is cooled.

6. System according to claim 1, wherein the ink transfer cylinder (7) is cooled.

7. System according to claim 1, wherein at least one of the ink measuring or metering rollers (10, 13) is axially oscillating.

8. System according to claim 1, wherein the ink transfer cylinder (7) is axially oscillating.

9. System according to claim 1, wherein the ink transfer cylinder (7) and the plate cylinder (9) are in direct engagement.

10. System according to claim 1, further including at least one idler cylinder or roller between the plate cylinder and the ink transfer cylinder, and carried along by friction.

11. System according to claim 1, wherein an ink trough (1) is provided, and the ink measuring or metering rollers (10, 13) are so positioned with respect to the ink trough that excess ink will drip off or flow down immediately back into the ink trough.

* * * * *